US011072488B1

(12) United States Patent
Goodman

(10) Patent No.: US 11,072,488 B1
(45) Date of Patent: Jul. 27, 2021

(54) REPLACEMENT AEROSOL NOZZLE ASSEMBLY

(71) Applicant: Jeffrey Goodman, Sultan, WA (US)

(72) Inventor: Jeffrey Goodman, Sultan, WA (US)

( * ) Notice: Subject to any disclaimer, the term of this patent is extended or adjusted under 35 U.S.C. 154(b) by 0 days.

(21) Appl. No.: 16/897,825

(22) Filed: Jun. 10, 2020

(51) Int. Cl.
*B65D 83/28* (2006.01)
*B65D 83/20* (2006.01)

(52) U.S. Cl.
CPC ..... *B65D 83/28* (2013.01); *B65D 83/205* (2013.01)

(58) Field of Classification Search
CPC ..... B65D 83/28; B65D 83/205
USPC ..... 222/402.13
See application file for complete search history.

(56) References Cited

U.S. PATENT DOCUMENTS 3,638,840 A 2/1972 Ishida
4,407,341 A 10/1983 Feldt
4,911,336 A 3/1990 Blake
6,481,470 B1 11/2002 Rubenic
7,044,338 B2 5/2006 Roden
8,152,030 B2 4/2012 Coroneos
8,523,023 B1 * 9/2013 Coroneos ..... B05B 15/14 222/402.1
10,793,343 B1 * 10/2020 Alonso ..... B65D 83/48
2008/0230559 A1 * 9/2008 Nardone ..... B65D 49/00 222/153.05
2011/0017780 A1 * 1/2011 Coroneos ..... B65D 83/207 222/402.1
2011/0107534 A1 5/2011 Hoctor
2011/0303705 A1 * 12/2011 Coroneos ..... B65D 83/207 222/402.1

* cited by examiner

*Primary Examiner* — Michael J. Melaragno

(57) ABSTRACT

A replacement aerosol nozzle assembly includes a coupler that is attachable around a neck of an aerosol container. A plunger is slidably attached to the coupler to engage a broken spray nozzle on the aerosol container when the coupler is attached to the neck of the aerosol container. A conduit is integrated into the plunger and the conduit fluidly engages the broken spray nozzle when the coupler is attached to the aerosol container. In this way the conduit is placed in fluid communication with an interior of the aerosol container. The plunger urges the broken spray nozzle downwardly when the plunger is depressed to spray contents of the aerosol container.

7 Claims, 4 Drawing Sheets

REPLACEMENT AEROSOL NOZZLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to replacement nozzle devices and more particularly pertains to a new replacement nozzle device for salvaging contents of an aerosol container with a broken spray nozzle

(2) Description of Related Art Including Information Disclosed Under 37 CFR 1.97 and 1.98

The prior art relates to replacement nozzle devices. The prior art discloses a spray nozzle that permits contents of an aerosol container to be salvaged when the spray nozzle is broken off. The prior art discloses an aerosol container emptying device for separating gaseous propellant from liquid contents of an aerosol container. Additionally, the prior art discloses a valve that is convertible between a pump type valve or an aerosol valve. The prior art discloses an aerosol device the punctures the valve on an aerosol container for salvaging contents of the aerosol container.

BRIEF SUMMARY OF THE INVENTION

An embodiment of the disclosure meets the needs presented above by generally comprising a coupler that is attachable around a neck of an aerosol container. A plunger is slidably attached to the coupler to engage a broken spray nozzle on the aerosol container when the coupler is attached to the neck of the aerosol container. A conduit is integrated into the plunger and the conduit fluidly engages the broken spray nozzle when the coupler is attached to the aerosol container. In this way the conduit is placed in fluid communication with an interior of the aerosol container. The plunger urges the broken spray nozzle downwardly when the plunger is depressed to spray contents of the aerosol container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
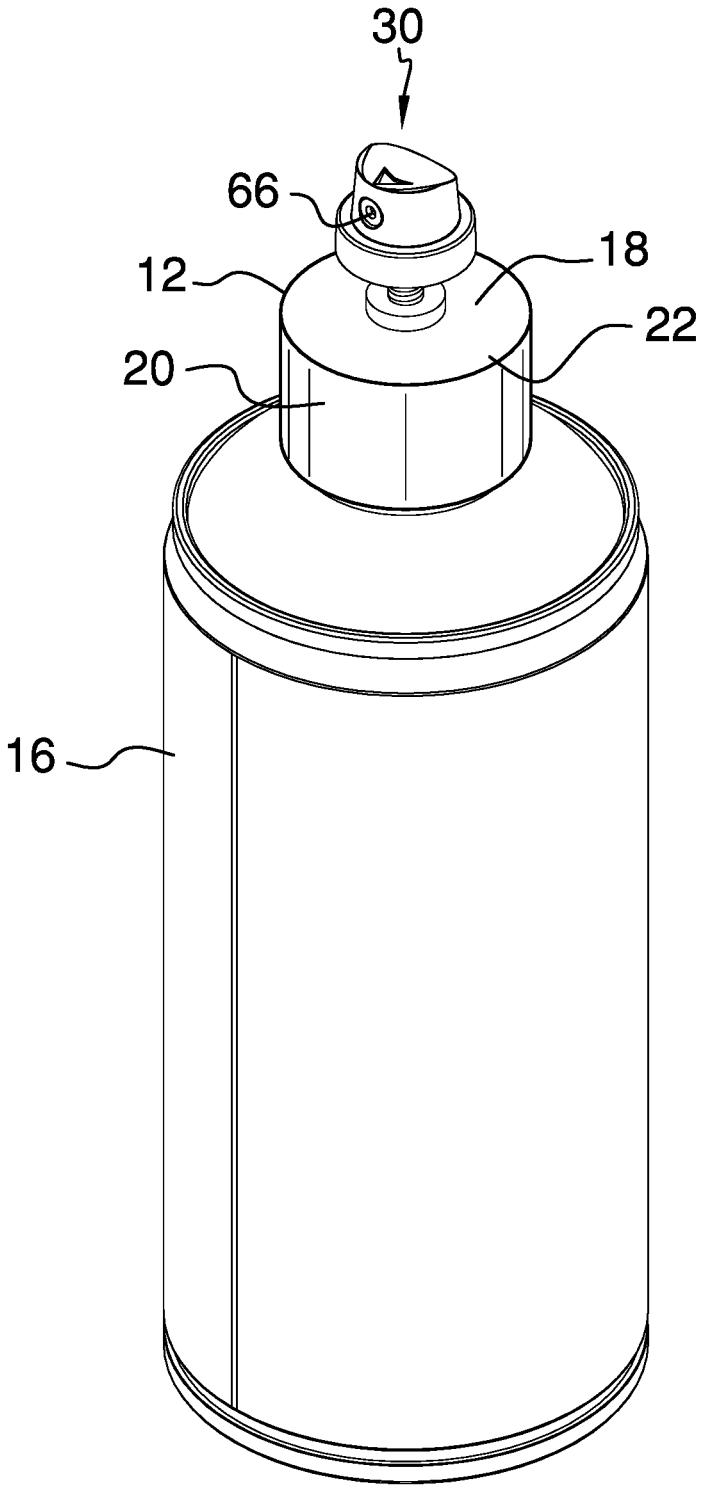
FIG. 1 is a perspective in-use view of a replacement aerosol nozzle assembly according to an embodiment of the disclosure.
Figure 2:
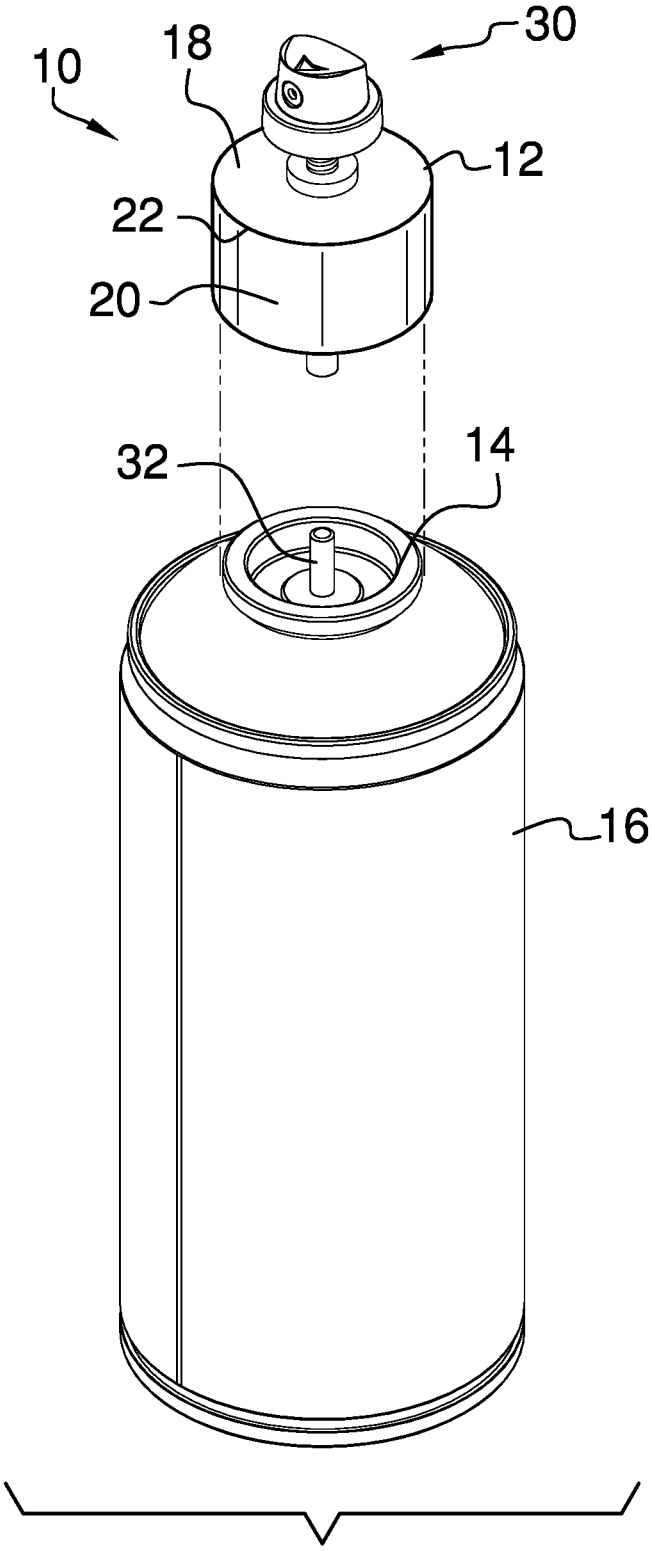
FIG. 2 is an exploded perspective view of an embodiment of the disclosure.
Figure 3:
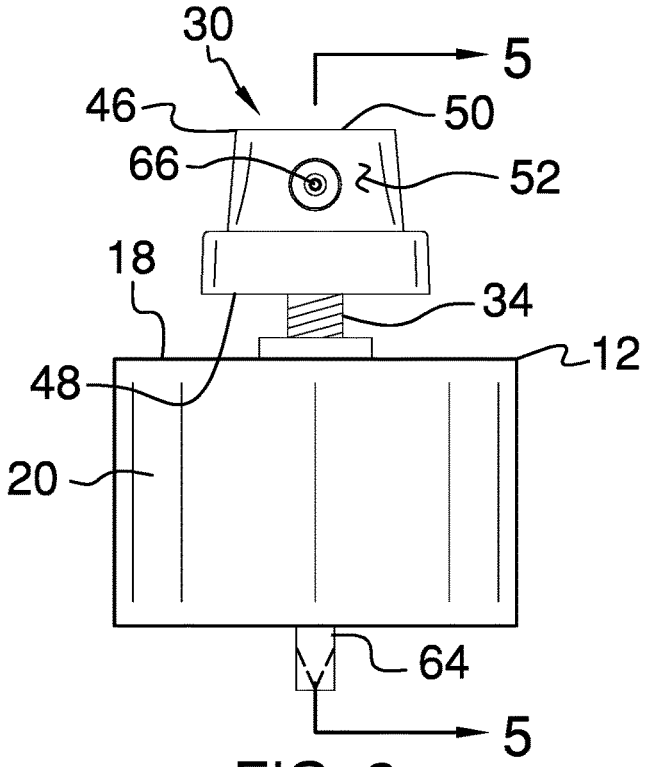
FIG. 3 is a front view of an embodiment of the disclosure.
Figure 4:
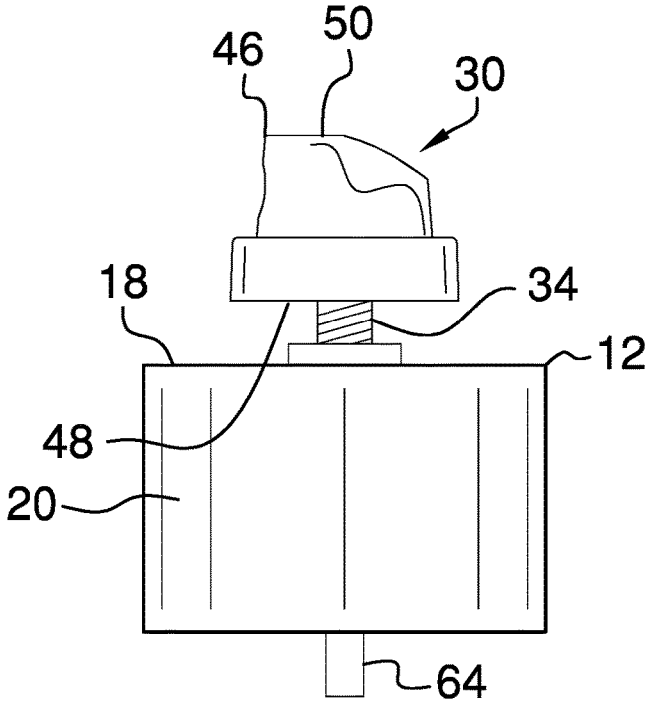
FIG. 4 is a left side view of an embodiment of the disclosure.
Figure 5:
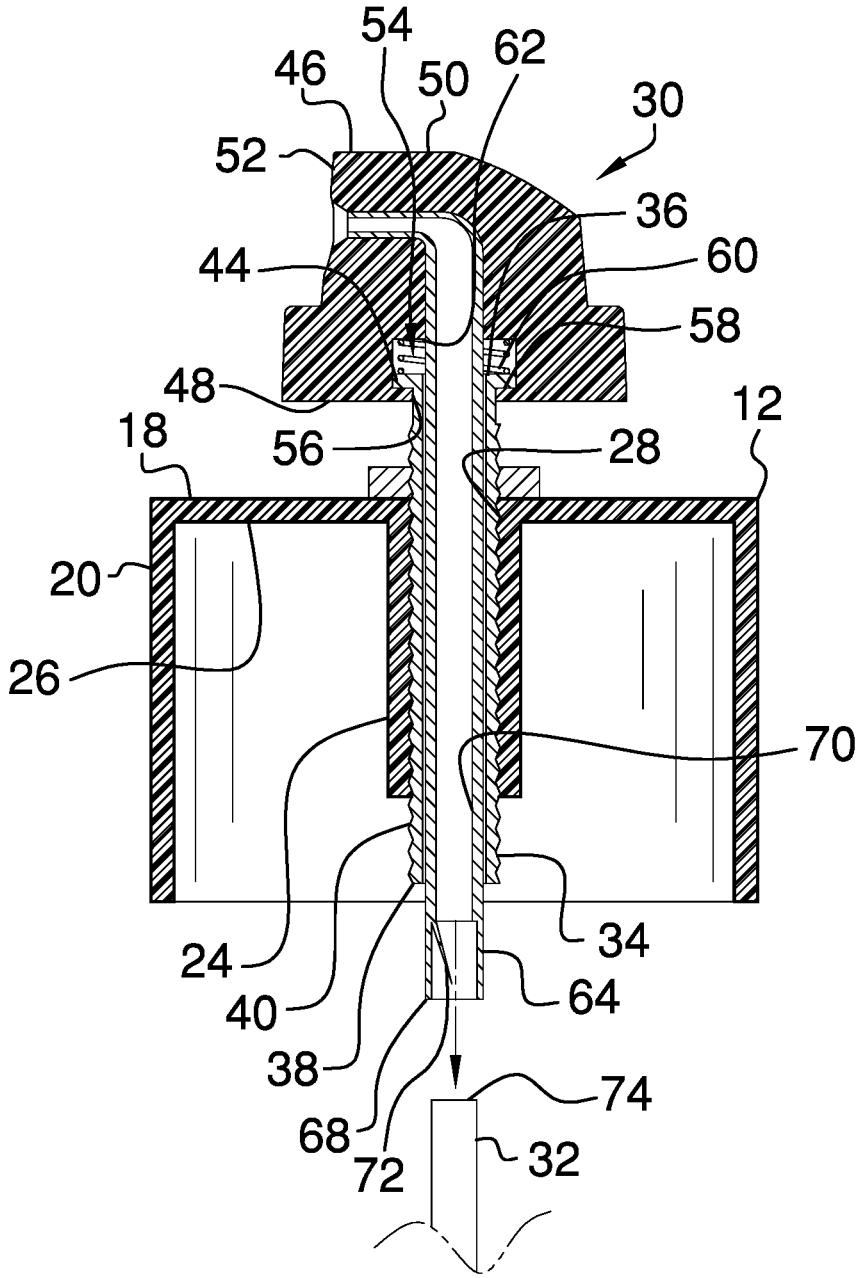
FIG. 5 is a cross sectional view taken along line 5-5 of FIG. 3 of an embodiment of the disclosure.

With reference now to the drawings, and in particular to FIGS. 1 through 5 thereof, a new replacement nozzle device embodying the principles and concepts of an embodiment of the disclosure and generally designated by the reference numeral 10 will be described.

As best illustrated in FIGS. 1 through 5, the replacement aerosol nozzle assembly 10 generally comprises a coupler 12 that is attachable around a neck 14 of an aerosol container 16. The aerosol container 16 may contain aerosolized paint, an aerosolized solvent or any other aerosolized chemical. The coupler 12 has a top wall 18 and an outer wall 20 coupled to and extending downwardly from a perimeter 22 of the top wall 18. The coupler 12 has a tube 24 extending downwardly from a bottom surface 26 of the top wall 18 and the tube 24 is centrally positioned on the top wall 18. Additionally, the outer wall 20 is continuously arcuate about the tube 24 and the top wall 18 has an opening 28 extending into the tube 24.

A plunger 30 is slidably attached to the coupler 12 to engage a broken spray nozzle 32 on the aerosol container 16 when the coupler 12 is attached to the neck 14 of the aerosol container 16. The plunger 30 comprises a sleeve 34 that has a top end 36, a bottom end 38 and an outer surface 40 extending therebetween, and the outer surface 40 is threaded. The sleeve 34 extends through the tube 24 in the coupler 12 having the outer surface 40 threadably engaging an inside surface 42 of the tube 24. The sleeve 34 extends outwardly from a bottom end 38 of the tube 24 and the sleeve 34 extends upwardly through the opening 28 in the top wall 18 of the coupler 12. Additionally, the top end 36 of the sleeve 34 flares outwardly from the outer surface 40 of the sleeve 34 to define a lip 44 on the sleeve 34.

The plunger 30 includes a button 46 that has a bottom surface 48, a top surface 50 and a perimeter surface 52 extending therebetween. The button 46 has a sleeve space 54 therein and the button 46 has a sleeve opening 56 extending upwardly through the bottom surface 48 and into the sleeve space 54. The sleeve opening 56 has a smaller diameter than the diameter of the sleeve space 54. The sleeve 34 extends into the sleeve 34 well having the lip 44 on the sleeve 34 abutting a lower surface 58 of the sleeve space 54. In this way the sleeve 34 is inhibited from being removed from the sleeve space 54.

A biasing member 60 is positioned between the lip 44 and an upper surface 62 of the sleeve space 54. The biasing member 60 biases the button 46 upwardly on the sleeve 34. Additionally, the button 46 is depressible downwardly on the sleeve 34. The biasing member 60 may comprise a spring or any other type of biasing member.

A conduit 64 is integrated into the plunger 30 and the conduit 64 fluidly engages the broken spray nozzle 32 when the coupler 12 is attached to the aerosol container 16. In this way the conduit 64 is in fluid communication with an interior of the aerosol container 16. The plunger 30 urges the broken spray nozzle 32 downwardly when the plunger 30 is depressed to spray contents of the aerosol container 16. The conduit 64 extends outwardly through the perimeter surface 52 of the button 46 to define a spray opening 66 in the perimeter surface 52. The conduit 64 extends downwardly through the sleeve 34 and the conduit 64 has a distal end 68 with respect to the sleeve 34 that is spaced from the bottom end 38 of the sleeve 34. The distal end 68 fluidly engages the broken spray nozzle 32.

An interior surface 70 of the conduit 64 has a finger 72 extending downwardly at an angle within the conduit 64. The finger 72 is positioned adjacent to the distal end 68 of the conduit 64 and the finger 72 engages a top end 74 of the broken spray nozzle 32. In this way the conduit 64 can depress the broken spray nozzle 32 when the button 46 is depressed for spraying the contents of the aerosol container 16 through the conduit 64.

In use, the coupler 12 is positioned over the neck 14 of the aerosol container 16 to facilitate the conduit 64 to engage the broken spray nozzle 32. The button 46 is depressed downwardly to spray the contents of the aerosol container 16. In this way the contents of an aerosol container 16 that had its spray button broken off can be salvaged. The coupler 12 is removable from the neck 14 of the aerosol container 16 when the contents of the aerosol container 16 have been depleted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A replacement aerosol nozzle assembly being configured to be attached to an aerosol can with a broken spray nozzle, said assembly comprising:

a coupler being attachable around a neck of an aerosol container;

a plunger being slidably attached to said coupler wherein said plunger is configured to engage a broken spray nozzle on the aerosol container when said coupler is attached to the neck of the aerosol container;

a conduit being integrated into said plunger, said conduit fluidly engaging the broken spray nozzle when said coupler is attached to the aerosol container wherein said conduit is configured to be in fluid communication with an interior of the aerosol container, said plunger urging the broken spray nozzle downwardly when said plunger is depressed wherein said conduit is configured to spray contents of the aerosol container;

wherein said coupler has a top wall and an outer wall being coupled to and extending downwardly from a perimeter of said top wall, said coupler having a tube extending downwardly from a bottom surface of said top wall, said tube being centrally positioned on said top wall, said outer wall being continuously arcuate about said tube, said top wall having an opening extending into said tube; and wherein said plunger comprises a sleeve having a top end, a bottom end and an outer surface extending therebetween, said outer surface being threaded, said sleeve extending through said tube in said coupler having said outer surface threadably engaging an inside surface of said tube, said sleeve extending outwardly from a bottom end of said tube, said sleeve extending upwardly through said opening in said top wall of said coupler, said top end of said sleeve flaring outwardly from said outer surface of said sleeve to define a lip on said sleeve.

2. The assembly according to claim 1, wherein said plunger comprises a button having a bottom surface, a top surface and a perimeter surface extending therebetween, said button having a sleeve space therein, said button having a sleeve opening extending upwardly through said bottom surface and into said sleeve space, said sleeve opening having a smaller diameter than the diameter of said sleeve space.

3. The assembly according to claim 2, wherein said sleeve extends into said sleeve well having said lip on said sleeve abutting a lower surface of said sleeve space to inhibit said sleeve from being removed from said sleeve space.

4. The assembly according to claim 3, wherein said plunger comprises a biasing member being positioned between said lip and an upper surface of said sleeve space, said biasing member biasing said button upwardly on said sleeve, said button being depressible downwardly on said sleeve.

5. The assembly according to claim 1, wherein conduit extends outwardly through said perimeter surface of said button to define a spray opening in said perimeter surface, said conduit extending downwardly through said sleeve, said conduit having a distal end with respect to said sleeve being spaced from said bottom end of said sleeve, said distal end fluidly engaging the broken spray nozzle.

6. The assembly according to claim 5, wherein an interior surface of said conduit has a finger extending downwardly at an angle within said conduit, said finger being positioned adjacent to said distal end of said conduit, said finger engaging a top end of the broken spray nozzle wherein said conduit is configured to depress the broken spray nozzle when said button is depressed for spraying the contents of the aerosol can through said conduit.

7. A replacement aerosol nozzle assembly being configured to be attached to an aerosol can with a broken spray nozzle, said assembly comprising:

a coupler being attachable around a neck of an aerosol container, said coupler having a top wall and an outer wall being coupled to and extending downwardly from a perimeter of said top wall, said coupler having a tube extending downwardly from a bottom surface of said top wall, said tube being centrally positioned on said top wall, said outer wall being continuously arcuate about said tube, said top wall having an opening extending into said tube;

a plunger being slidably attached to said coupler wherein said plunger is configured to engage a broken spray nozzle on the aerosol container when said coupler is attached to the neck of the aerosol container, said plunger comprising:

a sleeve having a top end, a bottom end and an outer surface extending therebetween, said outer surface being threaded, said sleeve extending through said tube in said coupler having said outer surface threadably engaging an inside surface of said tube, said sleeve extending outwardly from a bottom end of said tube, said sleeve extending upwardly through said opening in said top wall of said coupler, said top end of said sleeve flaring outwardly from said outer surface of said sleeve to define a lip on said sleeve;

a button having a bottom surface, a top surface and a perimeter surface extending therebetween, said button having a sleeve space therein, said button having a sleeve opening extending upwardly through said bottom surface and into said sleeve space, said sleeve opening having a smaller diameter than the diameter of said sleeve space, said sleeve extending into said sleeve well having said lip on said sleeve abutting a lower surface of said sleeve space to inhibit said sleeve from being removed from said sleeve space; and a biasing member being positioned between said lip and an upper surface of said sleeve space, said biasing member biasing said button upwardly on said sleeve, said button being depressible downwardly on said sleeve; and a conduit being integrated into said plunger, said conduit fluidly engaging the broken spray nozzle when said coupler is attached to the aerosol container wherein said conduit is configured to be in fluid communication with an interior of the aerosol container, said plunger urging the broken spray nozzle downwardly when said plunger is depressed wherein said conduit is configured to spray contents of the aerosol container, said conduit extending outwardly through said perimeter surface of said button to define a spray opening in said perimeter surface, said conduit extending downwardly through said sleeve, said conduit having a distal end with respect to said sleeve being spaced from said bottom end of said sleeve, said distal end fluidly engaging the broken spray nozzle, an interior surface of said conduit having a finger extending downwardly at an angle within said conduit, said finger being positioned adjacent to said distal end of said conduit, said finger engaging a top end of the broken spray nozzle wherein said conduit is configured to depress the broken spray nozzle when said button is depressed for spraying the contents of the aerosol can through said conduit.

* * * * *